US006283190B1

(12) United States Patent
Hu et al.

(10) Patent No.: US 6,283,190 B1
(45) **Date of Patent: *Sep. 4, 2001**

(54) PROGRAMMABLE WINDOW BLIND ASSEMBLY

(76) Inventors: Yu-Min Hu, No. 1-3, Alley 5, Lane 77, Ching-Jen St., Wen-Shan Dist.; Tom Huang, 4F, No. 45, Chung-Po N. Rd., Hsin-I Dist.; Fair Chang, No. 12-1, Lane 315, Sec. 2, Shih-Pai Rd., Pei-Tou Dist., all of Taipei City (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,075

(22) Filed: Feb. 26, 1999

(30) Foreign Application Priority Data

Aug. 27, 1998 (TW) ..... 87214101

(51) Int. Cl.[7] ..... A47H 5/00
(52) U.S. Cl. ..... 160/84.02; 160/168.1 P
(58) Field of Search ..... 160/84.02, 168.1 P, 160/188, 310; 318/445

(56) References Cited

U.S. PATENT DOCUMENTS 4,429,264 * 1/1984 Richmond .
4,965,502 * 10/1990 Ogasawara ..... 160/84.02
5,038,087 * 8/1991 Archer et al. ..... 160/84.02
5,170,108 * 12/1992 Peterson et al. ..... 160/84.02
5,198,974 * 3/1993 Orsat .
5,444,339 * 8/1995 Domel et al. ..... 160/168.1 P
5,467,808 * 11/1995 Bell .
5,847,525 * 12/1998 Cheron et al. .
5,883,480 * 3/1999 Domel et al. ..... 160/168.1 P
6,082,433 * 7/2000 Vafaie et al. .

* cited by examiner

*Primary Examiner*—Blair M. Johnson
(74) *Attorney, Agent, or Firm*—Jenkens & Gilchrist, P.C.

(57) ABSTRACT

A programmable window blind assembly includes a window blind device having a pull cord unit connected operably to a blind unit. A motor drive unit includes a bi-directional motor that has a drive shaft coupled to the pull cord unit such that rotation of the drive shaft can result in movement of the blind unit. A sensor unit generates motor rotation signals for indicating angular speed and angular displacement of the drive shaft. A programmable data storage device has blind position information stored therein. A processor controls the motor to operate in a first direction for moving the blind unit to a retracted position and in a second direction for moving the blind unit to an extended position. The processor is operable in a normal operating mode, where, based on the position information stored in the data storage device and the motor rotation signals from the sensor unit, the processor terminates operation of the motor in the first direction upon determining that the blind unit has reached the retracted position and terminates operation of the motor in the second direction upon determining that the blind unit has reached the extended position.

6 Claims, 7 Drawing Sheets

PROGRAMMABLE WINDOW BLIND ASSEMBLY

BACKGROUND OF THE INVENTION

1. Field of the Invention

The invention relates to a window blind assembly, more particularly to a programmable motor-incorporating window blind assembly.

2. Description of the Related Art

In a conventional motor-incorporating window blind assembly, mechanical positioning devices, such as limit switches, are employed in order to stop operation of a motor drive unit when a blind unit of the assembly is in a fully retracted or fully extended position. However, when manufacturing a window blind assembly having a blind unit with new dimensions, the locations of the mechanical positioning devices must be adjusted to suit the new dimensions of the blind unit. This inconveniences the manufacturing process, results in lower production efficiency, and does not allow for the consumer to make the adjustments on his own.

SUMMARY OF THE INVENTION

Therefore, the main object of the present invention is to provide a programmable motor-incorporating window blind assembly to facilitate the manufacturing process, increase production efficiency, allow the consumer to make the adjustments on his own, and prolong the service life of the assembly.

According to the present invention, a programmable window blind assembly comprises:

- a window blind device including a top housing, a blind unit, and a pull cord unit connected operably to the blind unit for moving the blind unit between a fully retracted position and an extended position relative to the top housing;
- a motor drive unit including a bi-directional motor that has a drive shaft coupled to the pull cord unit such that rotation of the drive shaft can result in movement of the blind unit between the fully retracted position and the extended position; and
- a controller including
  - a sensor unit associated operably with the drive shaft of the motor, the sensor unit generating motor rotation signals for indicating angular speed and angular displacement of the drive shaft,
  - a programmable data storage device for storing fully retracted blind position information and extended blind position information therein, and
  - a processor connected to the sensor unit, the programmable data storage device and the motor, the processor controlling the motor to operate in a first direction for moving the blind unit to the fully retracted position and in a second direction for moving the blind unit to the extended position,
  - wherein the processor is operable in a normal operating mode, where the processor terminates operation of the motor in the first direction upon determining that the blind unit has reached the fully retracted position based on the position information stored in the programmable data storage device and the motor rotation signals from the sensor unit, and where the processor terminates operation of the motor in the second direction upon determining that the blind unit has reached the extended position based on the position information stored in the programmable data storage device and the motor rotation signals from the sensor unit.

In the preferred embodiment, the processor is further operable in a blind position-learning mode, where the processor determines the fully retracted blind position information by operating the motor in the first direction to move the blind unit from a fully extended position toward the fully retracted position, and by monitoring the motor rotation signals from the sensor unit to determine if the blind unit has reached the fully retracted position, and where the processor stores the fully retracted blind position information determined thereby in the data storage device.

In a case where the extended position of the blind unit is a user-defined extended position, when the processor is operated in the blind position-learning mode, the processor further determines the extended blind position information by operating the motor in the second direction to move the blind unit away from the fully retracted positions by monitoring user-provided external control signals to determine if the blind unit has reached the user-defined extended position, and by monitoring the motor rotation signals from the sensor unit during movement of the blind unit from the fully retracted position to the user-defined extended position. The processor further stores the extended blind position information determined thereby in the data storage device.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
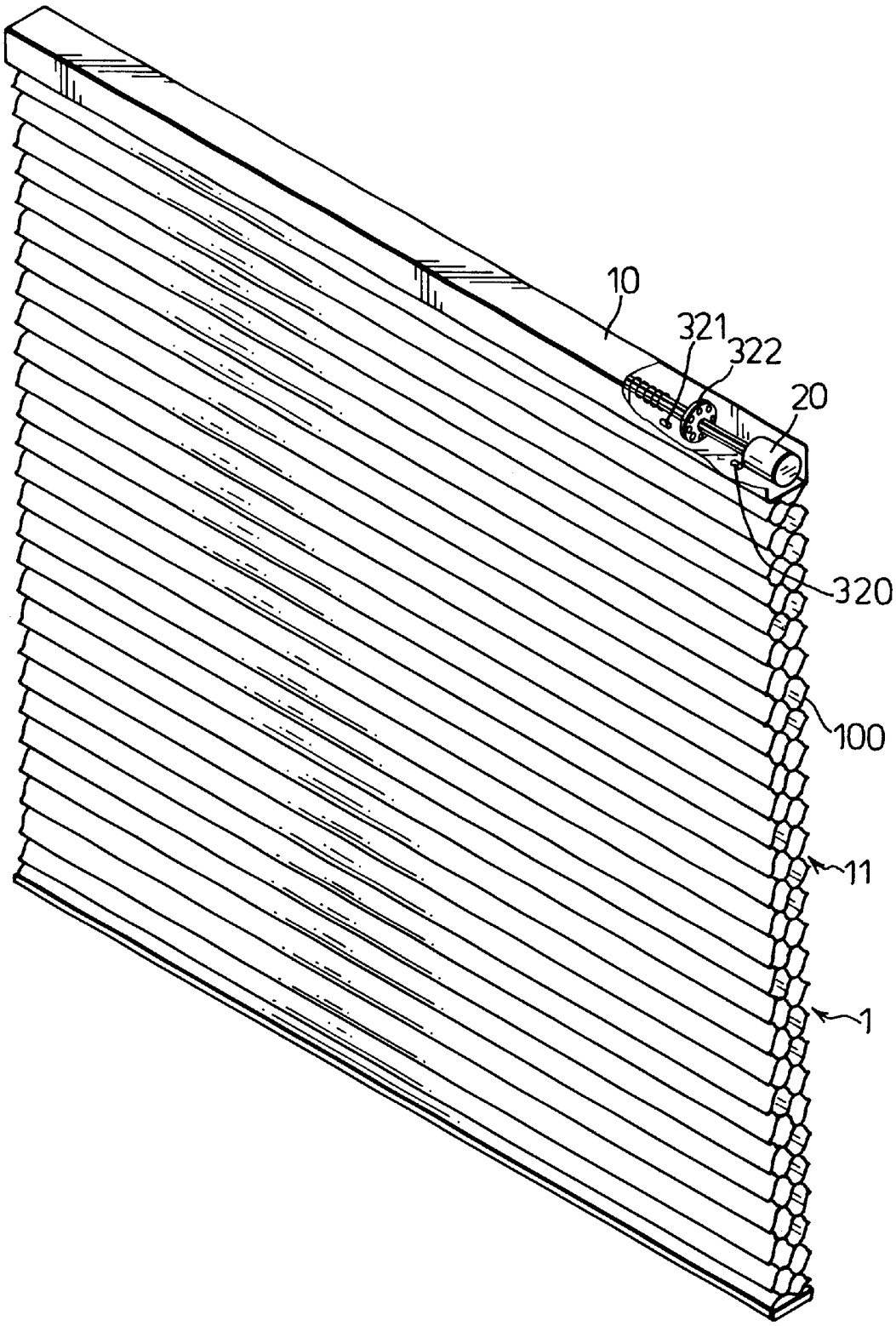
FIG. 1 is a perspective view of the preferred embodiment of a motor-incorporating programmable window blind assembly according to the present invention.
Figure 2:
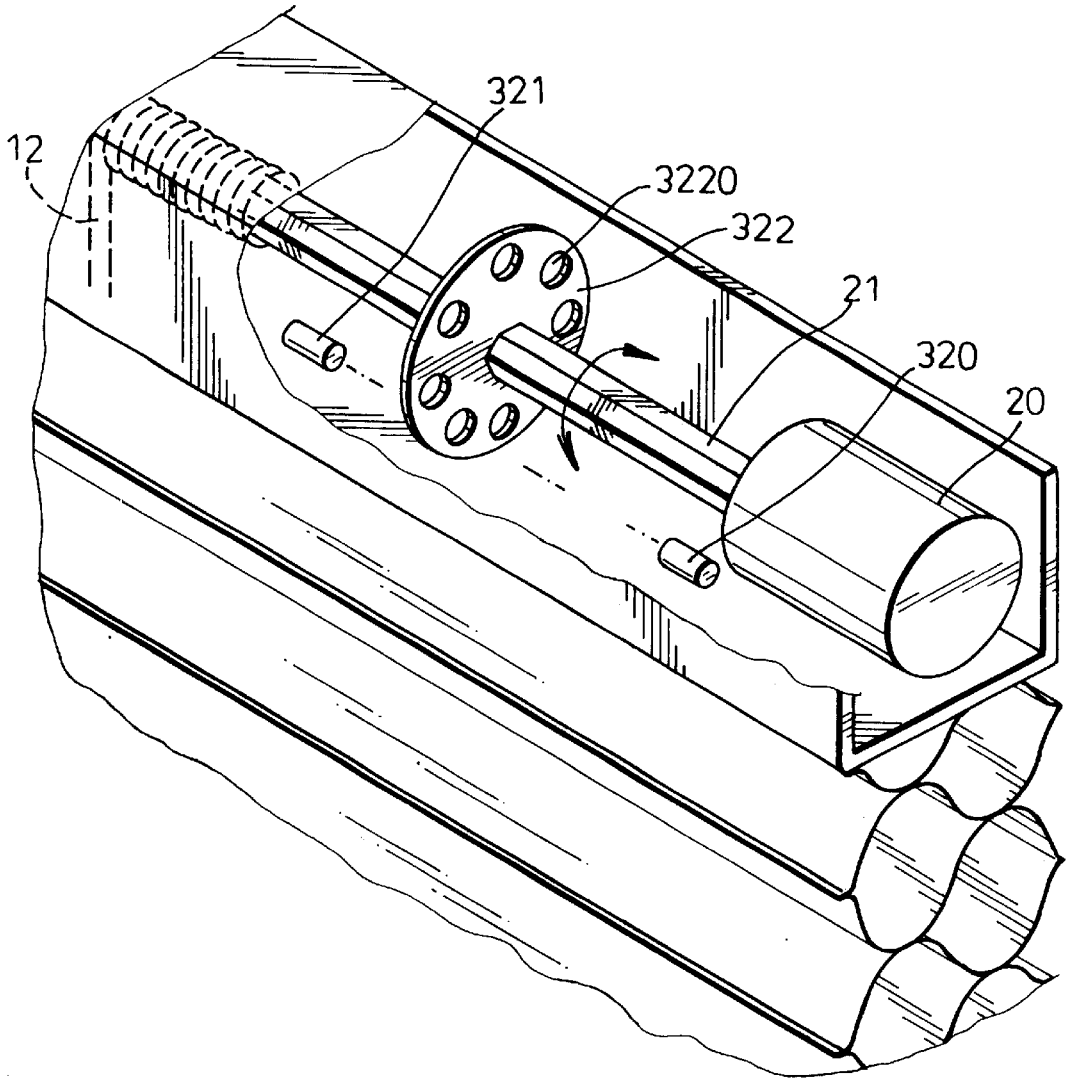
FIG. 2 is a fragmentary perspective view illustrating a sensing unit and a motor drive unit of the preferred embodiment.
Figure 3:
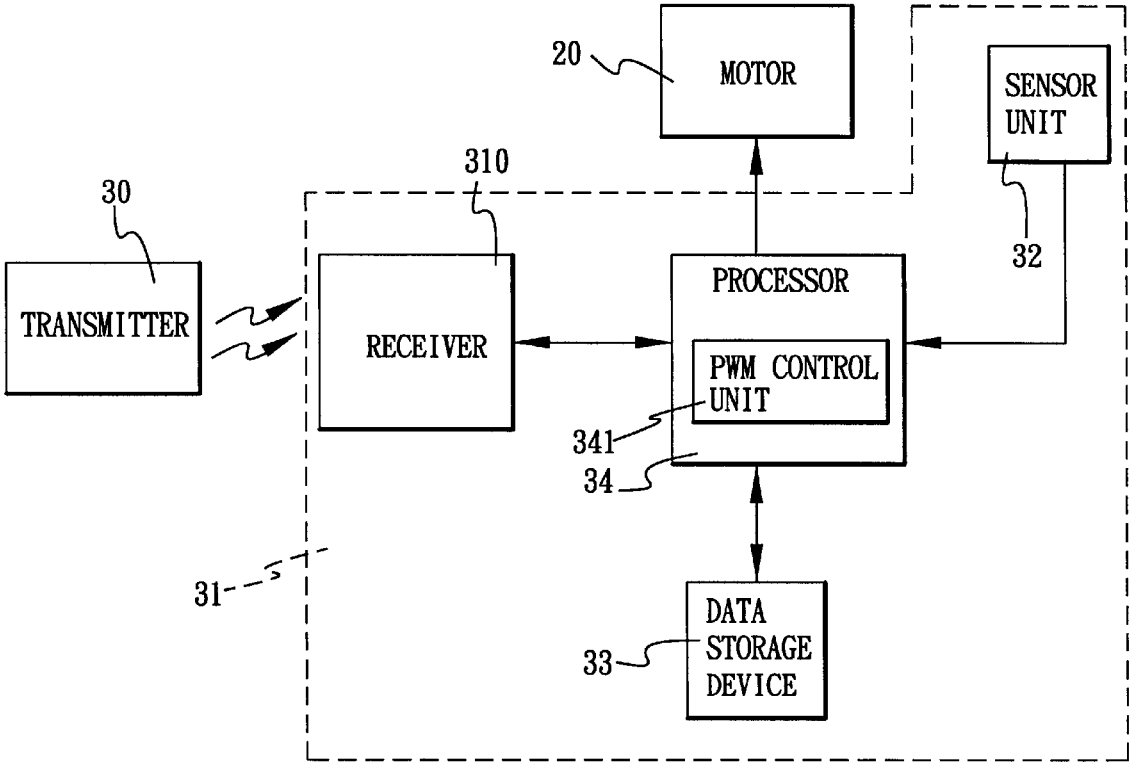
FIG. 3 is a schematic circuit block diagram of the preferred embodiment.
Figure 4:
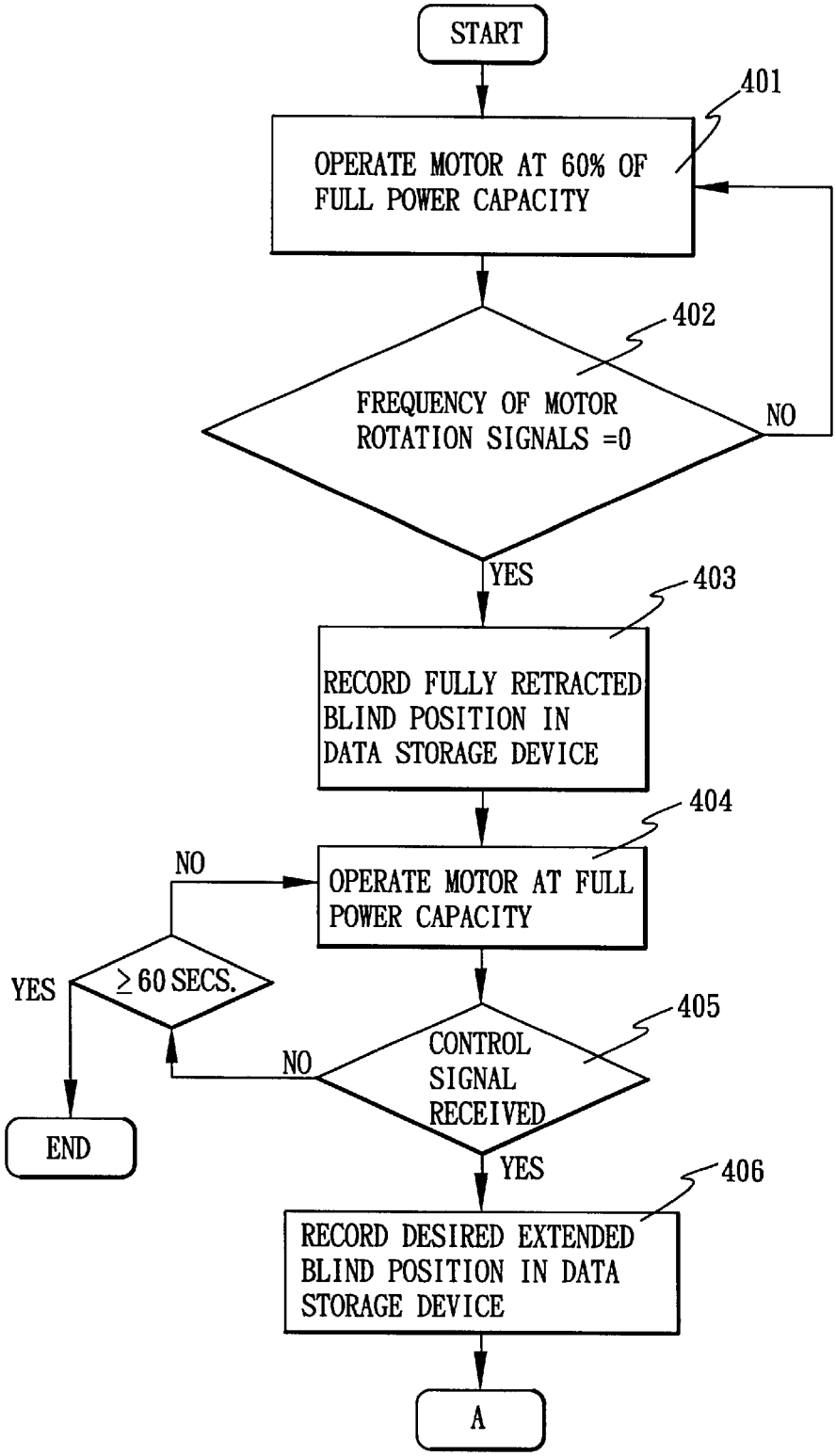
FIG. 4 is a flowchart illustrating operation of a processor of the preferred embodiment in a blind position-learning mode.
Figure 5:
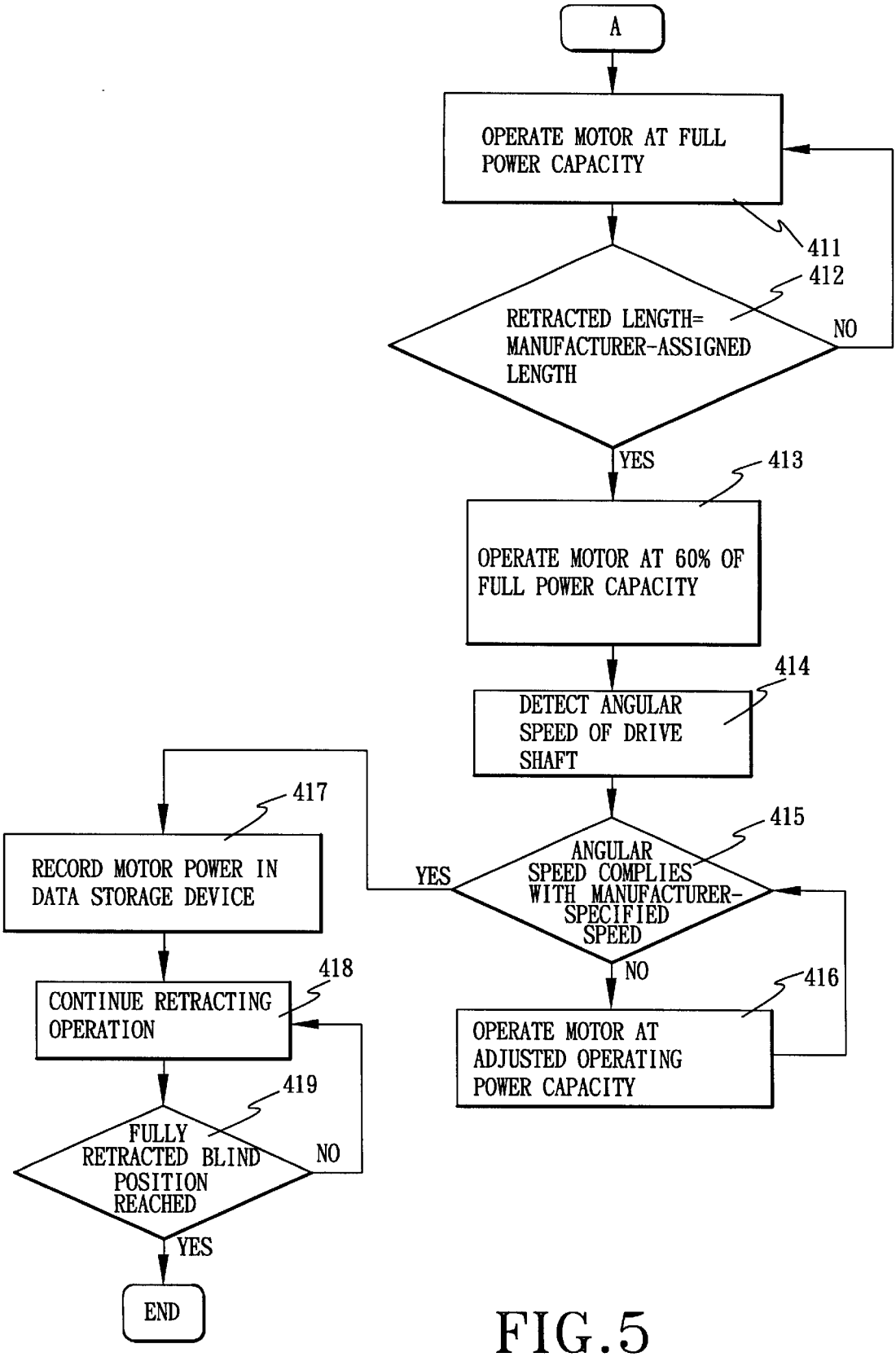
FIG. 5 is a flowchart illustrating operation of the processor of the preferred embodiment in a motor speed-learning mode.

Referring to FIGS. 1, 2 and 3, the preferred embodiment of a motor-incorporating programmable window blind assembly according to the present invention is shown to comprise a window blind device 1, a motor drive unit that includes a bi-directional motor 20, and a controller to control operation of the motor 20.

The window blind device 1 is conventional in construction, and generally includes an elongate horizontal top housing 10, a blind unit 11 formed from a plurality of horizontal slats 100, and a pull cord unit 12 connected operably to the blind unit 11 and operable so as to move the blind unit 11 between a retracted position and an extended position relative to the top housing 10.

The bi-directional motor 20 is mounted on the top housing 10, and has a drive shaft 21 coupled to one end of the pull cord unit 12 such that rotation of the drive shaft 21 can result in movement of the blind unit 11 between the retracted and extended positions in a known manner.

Figure 6:
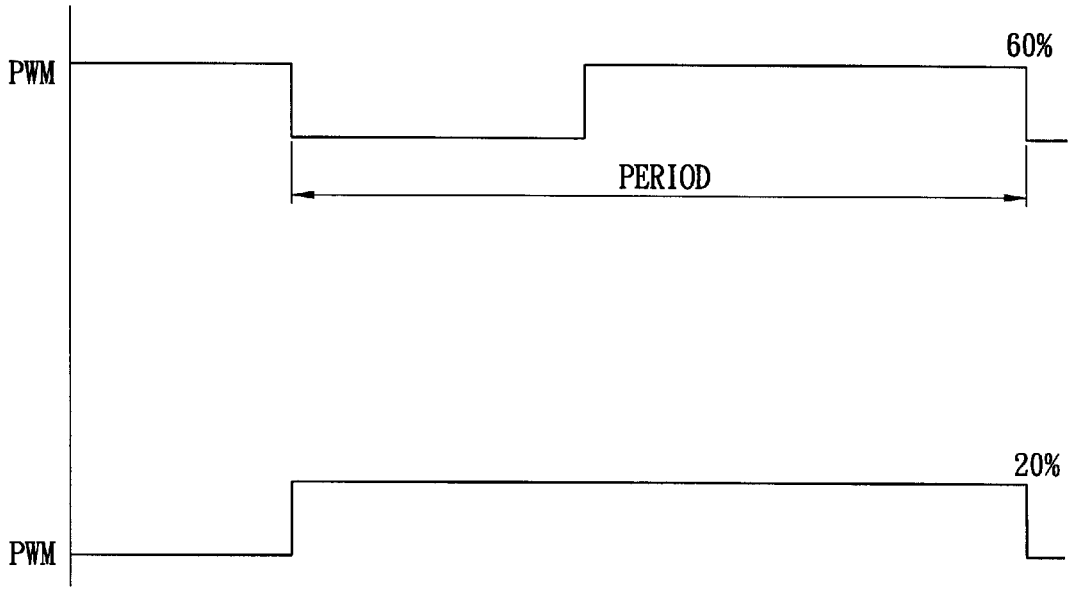
FIG. 6 illustrates PWM control signals generated by the processor to control speed of the motor drive unit according to the preferred embodiment.

The controller includes an infrared transmitter 30 that is manually operable so as to emit infrared user-provided external control signals, and a control circuit 31 mounted on the top housing 10. The control circuit 31 includes an infrared receiver 310 to receive the external control signals from the infrared transmitter 30, a sensor unit 32 to detect operation of the motor drive unit, a programmable data storage device 33, and a processor 34 connected to the infrared receiver 310, the sensor unit 32, the data storage device 33 and the bi-directional motor 20. The processor 34 is configured to include a pulse width modulator (PWM) control unit 341. As shown in FIG. 6, the PWM control unit 341 generates PWM control signals of varying widths to vary operating power to the bi-directional motor 20 and thus the operating speed of the motor 20 in a known manner.

In this embodiment, the sensor unit 32 is in the form of a photo-sensing unit that includes a photo emitter 320 mounted on the top housing 10, a photo receiver 321 mounted on the top housing 10 and spaced apart from the photo emitter 320 so as to define a light path therebetween, and a photo interrupting member 322 co-rotatable with the drive shaft 21 and disposed in the light path between the photo emitter 320 and the photo receiver 321 so as to interrupt periodically the light path to result in the generation of motor rotation signals at the photo receiver 321. The photo interrupting member 322 is preferably a slotted photo interrupting wheel mounted co-axially on the drive shaft 21. The photo interrupting wheel has a peripheral portion that is formed with a plurality of angularly displaced slots 3220 and that extends into the light path between the photo receiver 321 and the photo emitter 320 to interrupt periodically the light path according to rotation of the drive shaft 21. The motor rotation signals indicate the angular speed and angular displacement of the drive shaft 21.

The processor 34 is operable in a blind position-learning mode to record fully retracted and user-defined extended blind position information of the blind unit 11. The blind unit 11 is initially in a fully extended position (see FIG. 1) when the processor 34 is operated in the blind position-learning mode. With reference to FIGS. 1 to 4, in step 401, the PWM control unit 341 of the processor 34 initially operates the motor 20 in a first direction at a manufacturer-assigned operating power capacity, such as 60% of full power capacity, so as to move the blind unit 11 from the fully extended position toward the fully retracted position. Thereafter, in step 402, the processor 34 determines if the frequency of the motor rotation signals from the photo receiver 321 has dropped to 0, indicating that the blind unit 11 has reached the fully retracted position. In step 403, the processor 34 determines the fully retracted blind position information corresponding to angular displacement of the drive shaft 21 during movement of the blind unit 11 from the fully extended position to the fully retracted position in accordance with the motor rotation signals received from the photo receiver 321, and records the fully retracted blind position information in the data storage device 33.

In step 404, the processor 34 subsequently operates the motor 20 in a second direction at full power capacity so as to move the blind unit 11 away from the fully retracted position. When the blind unit 11 has reached the user-defined extended position, the infrared transmitter 30 is operated manually to generate external control signals that are received by the processor 34 via the infrared receiver 310. Upon detection of the external control signals in step 405, the flow proceeds to step 406, where the processor 34 deactivates the motor 20 and determines the extended blind position information corresponding to angular displacement of the drive shaft 21 during movement of the blind unit 11 from the fully retracted position to the user-defined extended position in accordance with the motor rotation signals received from the photo receiver 321, and records the extended blind position information in the data storage device 33. If a predetermined time period, such as 60 seconds, has elapsed and the external control signals have yet to be detected in step 405, an error signal will be generated, and the blind position-learning operation will be terminated.

Immediately after the blind position-learning operation, the processor 34 operates in a motor speed-learning mode. Referring to FIGS. 1, 2, 3 and 5, in step 411, with the blind unit 11 in the user-defined extended position, the PWM control unit 341 of the processor 34 initially controls the bi-directional motor 20 to operate at full power capacity in the first direction so as to move the blind unit 11 from the user-defined extended position toward the fully retracted position. In step 412, based on the position information stored in the data storage device 33 and on the motor rotation signals from the photo receiver 321, the processor 34 determines if a manufacturer-assigned length of the blind unit 11 has been retracted. In step 413, the processor 34 controls the motor 20 to operate at a manufacturer-designated fraction of the full power capacity, such as 60% of the full power capacity, once the retracted length of the blind unit 11 becomes equal to the manufacturer-assigned length. In step 414, according to the frequency of the motor control signals from the photo receiver 321 while the motor 20 is operated at the manufacturer-designated fraction of the full power capacity, the angular speed of the drive shaft 21 is detected to determine the retracting speed of the blind unit 11. In step 415, it is verified if the angular speed complies with a manufacturer-specified reduced retracting speed for retracting the blind unit 11 to avoid strong impact of the blind unit 11 with the top housing 10 during retracting movement of the former. The operating power to the motor 20 is continuously adjusted in step 416 until the angular speed complies with the manufacturer-specified reduced retracting speed. In step 417, the fraction of the full power capacity that is needed to operate the motor 20 in order to meet the manufacturer-specified reduced retracting speed is recorded by the processor 34 as reduced motor operating power information in the data storage device 33. Retracting of the blind unit 11 is continued in step 417, and in step 418, the processor 34 determines if the blind unit 11 has reached the fully retracted position based on the position information stored in the data storage device 33 and on the motor rotation signals from the photo receiver 321. The motor 20 is deactivated, and the motor speed-learning operation is terminated once the blind unit 11 has reached the fully retracted position.

Figure 7:
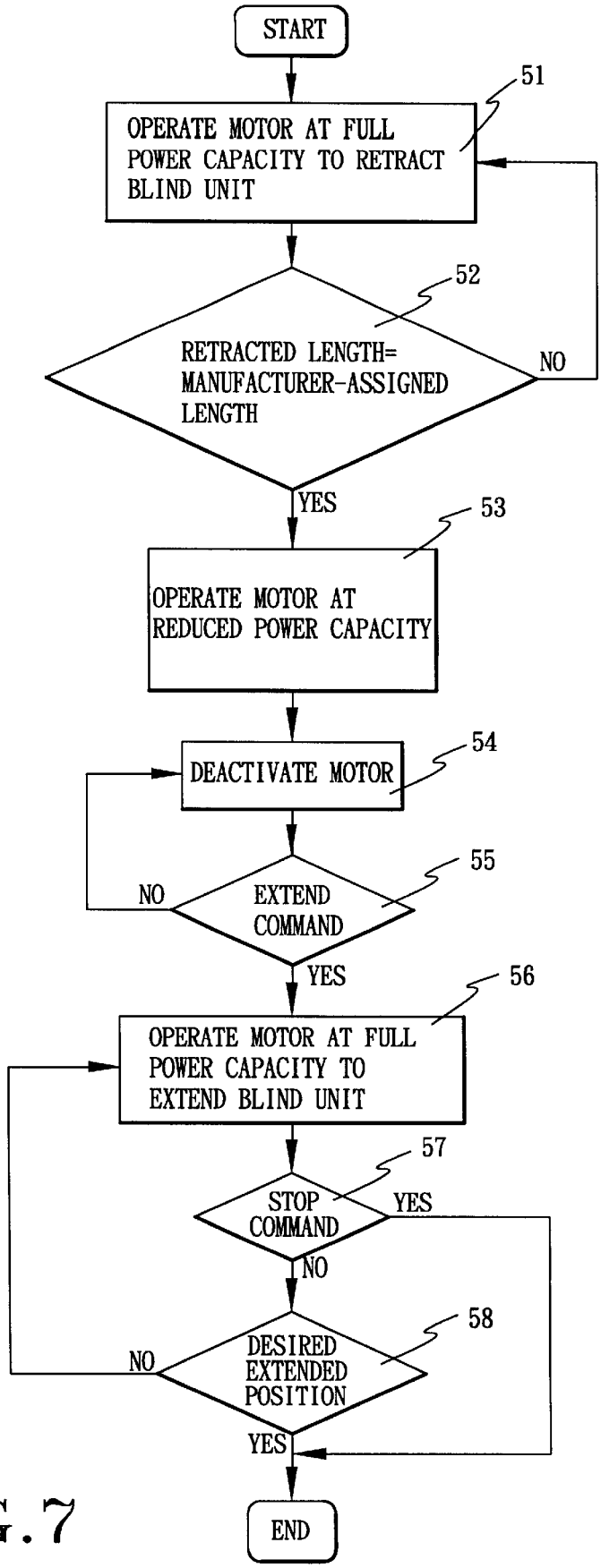
FIG. 7 is a flowchart illustrating operation of the processor of the preferred embodiment in a normal operating mode.

FIG. 7 illustrates a normal operating mode of the processor 34 of the preferred embodiment. When power is supplied to the window blind assembly, the processor 34 is able to detect whether the blind unit 11 is in the fully retracted position or the user-defined extended position based on previous operating data recorded in the data storage device 33. Referring to FIGS. 1, 2, 3 and 7, assuming that the blind unit 11 is initially in the user-defined extended position, the PWM control unit 341 of the processor 34 operates the motor 20 at full power capacity in step 51 so as to move the blind unit 11 from the user-defined extended position toward the fully retracted position. In step 52, based on the position information stored in the data storage device 33 and on the motor rotation signals from the photo receiver 321, the processor 34 determines if the retracted length of the blind unit 11 is equal to the manufacturer-assigned length. In step 53, when the retracted length of the blind unit 11 becomes equal to the manufacturer-assigned length, the processor 34 operates the motor 20 at a fraction of the full power capacity according to the reduced motor operating power information stored in the data storage device 33, thereby reducing the retracting speed of the blind unit 11. In step 54, the processor 34 deactivates the motor 20 upon determining that the blind unit 11 has reached the fully retracted position based on the position information stored in the data storage device 33 and on the motor rotation signals from the photo receiver 321, and the processor 34 enters a wait state in step 55 to wait for a subsequent command from the infrared transmitter 30.

Once the processor 34 receives a command to extend the blind unit 11 from the infrared transmitter 30 via the infrared receiver 310, the flow proceeds to step 56, where the processor 34 controls the motor 20 to operate at full power capacity to extend the blind unit 11. As the blind unit 11 moves to the user-defined extended position, the processor 34 monitors the presence of a stop command issued by the infrared transmitter 30 in step 57. The motor 20 is immediately deactivated upon detection of the stop command. In step 58, the processor 34 determines if the blind unit 11 has reached the user-defined extended position based on the position information stored in the data storage device 33 and on the motor rotation signals from the photo receiver 321. The motor 20 is deactivated when the blind unit 11 reaches the user-defined extended position. Otherwise, operation of the motor 20 to move the blind unit 11 to the user-defined extended position is continued.

It is noted that the sensor unit should not be limited to the type employed in the preferred embodiment. A Hall-effect sensor is equally applicable to detect the angular displacement and angular speed of the drive shaft 21 of the bi-directional motor 20. Moreover, operation of the processor 34 in the motor speed-learning mode is optional since the reduction in the retracting speed of the blind unit 11 can be programmed beforehand during the manufacturing stage. In addition, the window blind assembly can further be modified so that, in the motor speed-learning mode, the manufacturer-assigned length and the manufacturer-specified reduced speed can be varied as desired by the consumer.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A programmable window blind assembly, comprising:

a window blind device including a top housing, a blind unit, and a pull cord unit connected operably to said blind unit for moving said blind unit between a fully retracted position and an extended position relative to said top housing;

a motor drive unit including a bi-directional motor that has a drive shaft coupled to said pull cord unit such that rotation of said drive shaft can result in movement of said blind unit between the fully retracted position and the extended position; and a controller including a sensor unit associated operably with said drive shaft of said motor, said sensor unit generating motor rotation signals for indicating angular speed and angular displacement of said drive shaft;

a programmable data storage device for storing fully retracted blind position information and extended blind position information which may be user-defined therein; and a processor connected to said sensor unit, said programmable data storage device and said motor, said processor controlling said motor to operate in a first direction for moving said blind unit to the fully retracted position and in a second direction for moving said blind unit to the extended position, wherein said processor is operable in a normal operating mode, where said processor terminates operation of said motor in the first direction upon determining that said blind unit has reached the fully retracted position based on the position information stored in said programmable data storage device and the motor rotation signals from said sensor unit, and where said processor terminates operation of said motor in the second direction upon determining that said blind unit has means for generating an error signal when passage of said predetermined time has occurred, and means for terminating operation in said blind position learning mode upon occurrence of said error signal.

2. The programmable window blind assembly as claimed in claim 1, wherein said sensor unit includes a photo-sensing unit.

3. The programmable window blind assembly as claimed in claim 2, wherein said photo-sensing unit includes:

a photo emitter mounted on said top housing;

a photo receiver mounted on said top housing and spaced apart from said photo receiver so as to define a light path therebetween; and a photo interrupting member co-rotatable with said drive shaft and disposed in the light path between said photo emitter and said photo receiver so as to interrupt periodically the light path to result in the generation of the motor rotation signals at said photo receiver.

4. The programmable window blind assembly as claimed in claim 3, wherein said photo interrupting member is a slotted photo interrupting wheel mounted co-axially on said drive shaft, said photo interrupting wheel having a peripheral portion that is formed with a plurality of angularly displaced slots and that extends into the light path between said photo emitter and said photo receiver to interrupt periodically the light path according to rotation of said drive shaft.

5. The programmable window blind assembly as claimed in claim 1, wherein said programmable data storage device further stores reduced motor operating power information therein, and wherein when said processor controls said motor to operate in the first direction for moving said blind unit to the fully retracted position, said processor initially operating said motor at full power capacity until a predetermined length of said blind unit has been retracted, said processor subsequently controlling said motor to operate at a fraction of the full power capacity according to the reduced motor operating power information stored in said data storage device to reduce retracting speed of said blind unit once the predetermined length of said blind unit has been retracted.

6. The programmable window blind assembly as claimed in claim 5, wherein said processor is further operable in a motor speed-learning mode, where said processor determines the reduced motor operating power information by initially controlling said motor to operate in the first direction at the full power capacity for moving said blind unit from the extended position until the predetermined length of said blind unit has been retracted, and by subsequently controlling said motor to operate at a reduced power capacity that is continuously adjusted with reference to the motor rotation signals from said sensor unit until said blind unit moves with a preset reduced retracting speed, and where said processor stores the reduced motor operating power information determined thereby in said data storage device.

* * * * *